US008162439B2

(12) United States Patent
Doi et al.

(10) Patent No.: US 8,162,439 B2
(45) Date of Patent: Apr. 24, 2012

(54) METHOD FOR MANUFACTURING NOZZLE PLATE FOR LIQUID EJECTION HEAD, NOZZLE PLATE FOR LIQUID EJECTION HEAD AND LIQUID EJECTION HEAD

(75) Inventors: Isao Doi, Toyonaka (JP); Tomoko Miyaura, Habikino (JP); Hiroshi Oshitani, Amagasaki (JP)

(73) Assignee: Konica Minolta Holdings, Inc., Tokyo (JP)

( * ) Notice: Subject to any disclaimer, the term of this patent is extended or adjusted under 35 U.S.C. 154(b) by 210 days.

(21) Appl. No.: 12/452,101

(22) PCT Filed: Jun. 3, 2008

(86) PCT No.: PCT/JP2008/060193

§ 371 (c)(1),
(2), (4) Date: Dec. 15, 2009

(87) PCT Pub. No.: WO2008/155986

PCT Pub. Date: Dec. 24, 2008

(65) Prior Publication Data

US 2010/0134560 A1 Jun. 3, 2010

(30) Foreign Application Priority Data

Jun. 20, 2007 (JP) ..... 2007-162338

(51) Int. Cl.
*B41J 2/335* (2006.01)
*B41J 2/16* (2006.01)

(52) U.S. Cl. ..... 347/44; 347/45; 216/27

(58) Field of Classification Search ..... 347/20, 347/44, 74, 45; 216/27; 29/890.1
See application file for complete search history.

(56) References Cited

U.S. PATENT DOCUMENTS 6,569,343 B1 5/2003 Suzuki et al.
2007/0278181 A1 12/2007 Tsuboi et al.

FOREIGN PATENT DOCUMENTS

JP 02-105413 A 4/1990
JP 2005-144571 A 6/2005
JP 2005-212131 A 8/2005
JP 2006-130868 A 5/2006
JP 2007-055241 A 3/2007

OTHER PUBLICATIONS

Machine-generated translation of JP 2005-212131, published on Aug. 2005.*
Machine-generated translation of JP 2007-055241, published on Mar. 2007.*
Machine-generated translation of JP 2001-071510, published on Mar. 2001.*

* cited by examiner

*Primary Examiner* — Huan Tran
(74) *Attorney, Agent, or Firm* — Holtz, Holtz, Goodman & Chick, PC

(57) ABSTRACT

Provided is a method for manufacturing a nozzle plate which has a through hole having an ejection port. In the method, the through hole, which has one opening as an ejection port for ejecting the liquid, is arranged on a Si substrate by an anisotropic etching method wherein etching and side wall protection film formation are alternately repeated to the Si substrate and the following steps are performed in the following order; forming a film to be an etching mask on a surface of the Si substrate whereupon the ejection port is to be formed, forming the etching mask pattern having an opening for forming the thorough hole by performing photolithography and etching to a film to be the etching mask, and performing the etching by the anisotropic etching method by satisfying the conditional expression.

4 Claims, 4 Drawing Sheets

METHOD FOR MANUFACTURING NOZZLE PLATE FOR LIQUID EJECTION HEAD, NOZZLE PLATE FOR LIQUID EJECTION HEAD AND LIQUID EJECTION HEAD

This application is the United States national phase application of International Application PCT/JP2008/060193 filed Jun. 3, 2008.

FIELD OF THE INVENTION

The present invention relates to a method for manufacturing a nozzle plate for a liquid ejection head, a nozzle plate for a liquid ejection head, and a liquid ejection head.

BACKGROUND OF THE INVENTION

In recent years, a high speed printing with high resolution has been demanded for an inkjet type printer. As a method for forming components of an inkjet type recording head used for the above printer, some printers employ a semiconductor process used for a silicon substrate and the like, which is a fine processing technology in a micromachine field. As one of such components of an inkjet type recording head, there has been known a nozzle plate, in which a nozzle orifice (a through hole having one opening as an ejection port), which ejects liquid droplets, is formed by etching a silicon substrate.

As a method for carrying out an etching processing having high selectivity in a vertical direction (in a thickness direction) of a silicon substrate, it has been known an anisotropic etching process in which etching and side wall protection film formation (deposition) are alternately repeated. (For example, refer to Patent Document 1.)

As a deep groove formation technology of silicon by such the anisotropic etching process, it has been known a technology called the "Bosch process". For example, in Patent Document 2, as a method for forming a nozzle orifice on a silicon substrate, a nozzle orifice is formed by the Bosch process using the ICP (Inductively Coupled Plasma) type RIE (Reactive Ion Etching) apparatus.

The Bosch process forms an orifice by carrying out etching with repeating an etching step and deposition step as described above. It has been known that the side wall of the orifice thus formed creates a wavy pattern, called "scallops", which is recognized on a surface of a scallop (refer to Patent Document 3). By satisfying a formula $b/a \geqq 1.7$, wherein the depth of the concave portion and the cycle between the convex portions of the above wavy pattern are set to be "a" and "b" respectively, the wavy pattern formed on the side wall is allowed to be muffled (smooth).

Patent Document 1: Japanese Patent application Publication (hereinafter referred to as JP-A) No. H2-105413

Patent Document 2: JP-A No. 2005-144571 (pp. 5-6)

Patent Document 3: JP-A No. 2006-130868

DISCLOSURE OF INVENTION

Problems to be Solved by the Invention

The size (diameter) of an ejection port of a nozzle orifice (a through hole having one opening as an ejection port), which is arranged to a nozzle plate, is minute, for example 1 to 10 μm in diameter, due also to demand in recent years of high resolution printing, but its shape also needs to be made with high precision. In addition, one nozzle plate is generally provided with a plurality of the above minute nozzle orifices, and the opening shape and size of the ejection port are required to be uniform to achieve high quality printing.

The inventors manufactured a nozzle plate provided with minute nozzle orifices described above on a silicon substrate using an anisotropic etching process described in Patent Documents 1 to 3, in which etching and side wall protection film formation are alternately repeated. However, a problem occurred such that a desired nozzle orifice can not be obtained. Specifically, the diameter of the ejection port obtained by processing is large compared to an etching mask pattern for forming the nozzle orifice, and its opening loses its circular shape. Therefore, the nozzle orifice having the desired size and shape was not obtained, and as a result, high quality high resolution printing could not be achieved.

The present invention has been achieved in consideration of such problems, and it is an object of the invention to provide a method for manufacturing a nozzle plate having a through hole in which one opening thereof is an ejection port having an opening shape equivalent to an etching mask pattern, even if the nozzle orifice is minute, wherein it is performed by optimization of processing conditions in an anisotropic etching process; the nozzle plate which is manufactured by the above manufacturing method; and a liquid ejection head which is provided with the nozzle plate.

Means for Solving the Problems

The above problems can be solved by constitutions below.

Item 1. A method for manufacturing a nozzle plate for a liquid ejection head, wherein a through hole whose one opening is an ejection port ejecting liquid is arranged on a Si substrate by an anisotropic etching process in which etching and side wall protection film formation are alternately repeated in the Si substrate, the method comprising the following steps performed in the following order:

forming a film to be an etching mask on a surface of the Si substrate whereupon the ejection port is to be formed;

forming the etching mask pattern having an opening for forming the through hole by performing photolithography and etching to a film to be the etching mask; and performing etching by the anisotropic etching process by satisfying a conditional relationship below:

$$D \leqq 0.1 \times R$$

where D is a depth of an etching per one cycle, wherein, in the anisotropic etching process, a repeating unit in which etching and side wall protection film formation are alternately repeated is set to be one cycle, and R is a diameter of an opening of the etching mask pattern to form the through hole.

Item 2. The method for manufacturing a nozzle plate for a liquid ejection head of described in Item 1, comprising providing a liquid repellent layer on the surface of the Si substrate having the ejection port.

Item 3. A nozzle plate for a liquid ejection head manufactured by the method for manufacturing a nozzle plate for a liquid ejection head described in Item 1 or 2.

Item 4. A liquid ejection head comprising the nozzle plate for a liquid ejection head described in Item 3 and a body plate having a flow channel groove which supplies liquid to be ejected from the ejection port of the nozzle plate for the liquid ejection head.

Effects of the Invention

According to the present invention, a nozzle plate can be made by forming a through hole in which one opening thereof is an ejection port, by performing under prescribed conditions an anisotropic etching in which etching and side wall protection film formation are alternately repeated on the Si substrate on which an etching mask pattern having an opening shape of an ejection port which ejects liquid is arranged. Therefore, the opening shape of the ejection port, which is equivalent to the etching mask pattern, can be formed.

Therefore, it is possible to provide a method for manufacturing a nozzle plate having a through hole in which one opening thereof is an ejection port having an opening shape equivalent to an etching mask pattern; the nozzle plate which is manufactured by the above manufacturing method; and a liquid ejection head which is provided with the above nozzle plate.

DESCRIPTION OF REFERENCE NUMERALS

Figure 1:
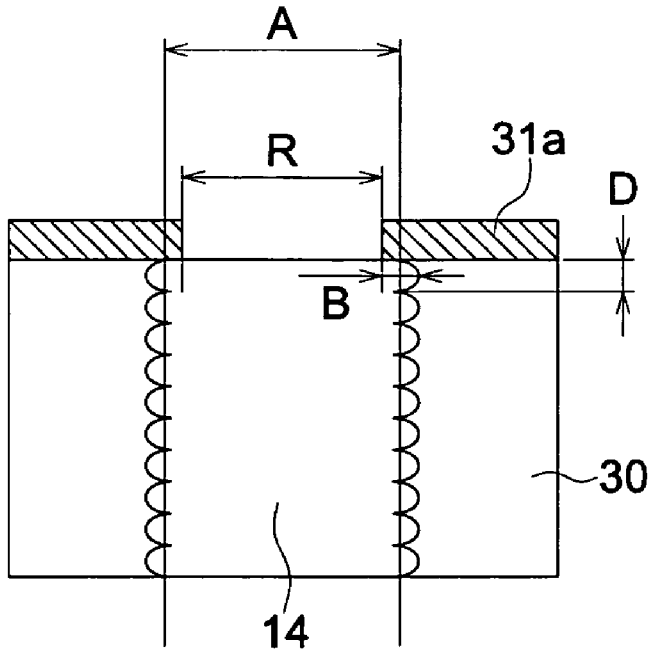
FIG. 1 is a figure showing a relation between an etching amount in the depth direction (a vertical direction) and an etching amount in the lateral direction.

1: a nozzle plate
2: a body plate
3: a piezoelectric element
11: a nozzle
12: an ejection surface
13: an ejection port
14: a small diameter section
15: a large diameter section
21: an ink supply port
22: a common ink chamber (a groove)
23: an ink supply channel (a groove)
24: a pressure chamber (a groove)
30: a Si substrate
31 and 32: a heat oxidation film
31*a* and 32*a*: an etching mask pattern
34 and 44: photoresist
44*a* and 34*a*: a photoresist pattern
45: a liquid repellent layer
D: an etching amount in a depth direction per one cycle
B: an etching amount in a direction perpendicular to a depth direction
R: an opening diameter of an etching mask pattern
A and A': an opening diameter of a small diameter section
U: an inkjet type recording head

BEST MODE FOR CARRYING OUT THE INVENTION

The present invention will be explained based on illustrated embodiments, but the present invention is not limited to the aforesaid embodiments.

Figure 3:
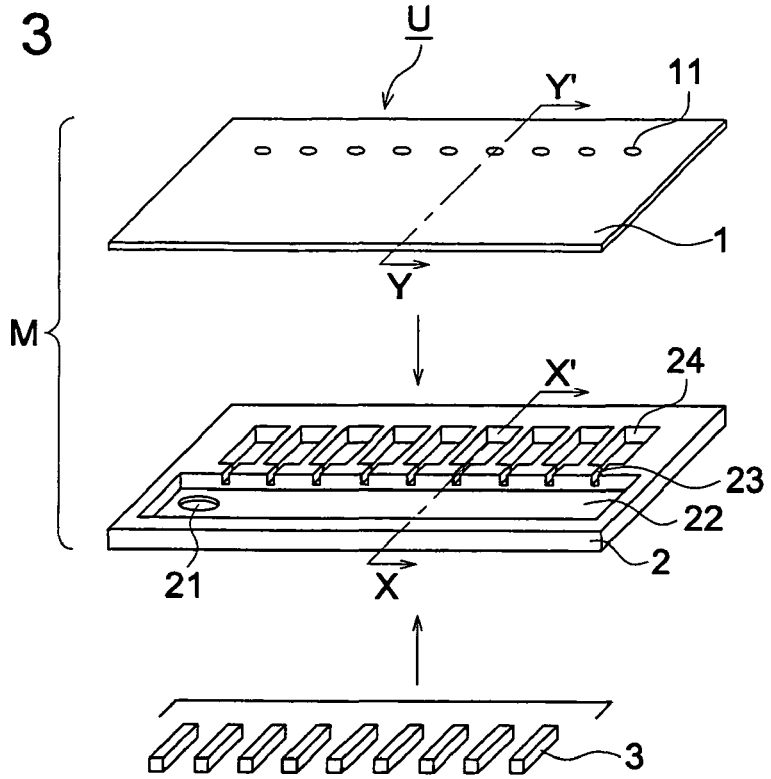
FIG. 3 is a figure showing an example of an inkjet type recording head.

FIG. 3 schematically shows the nozzle plate 1, the body plate 2, and the piezoelectric element 3, which constitute an inkjet type recording head (hereinafter referred to as a recording head) U, which is an example of the liquid ejection head.

A plurality of nozzle orifices 11 for ink ejection are arranged on the nozzle plate 1. On the body plate 2, there are formed the pressure chamber groove 24, the ink supply channel groove 23, the common ink chamber groove 22, and the ink supply port 21; each of the above grooves becomes a pressure chamber for supplying liquid ejected from an ejection port, an ink supply channel, and a common ink chamber, respectively, by pasting the above body plate with the nozzle plate 1.

A flow channel unit M is formed by pasting the nozzle plate 1 and the body plate 2 together so that each nozzle orifice 11 of the nozzle plate 1 and each pressure chamber groove 24 of the body plate 2 correspond to each other. Hereinafter, each numeric designation, which was used for the above explanation of the pressure chamber groove, the supply channel groove, and the common ink chamber groove, is also used for each of the pressure chamber, the supply channel, and the common ink chamber, respectively.

Figure 4:
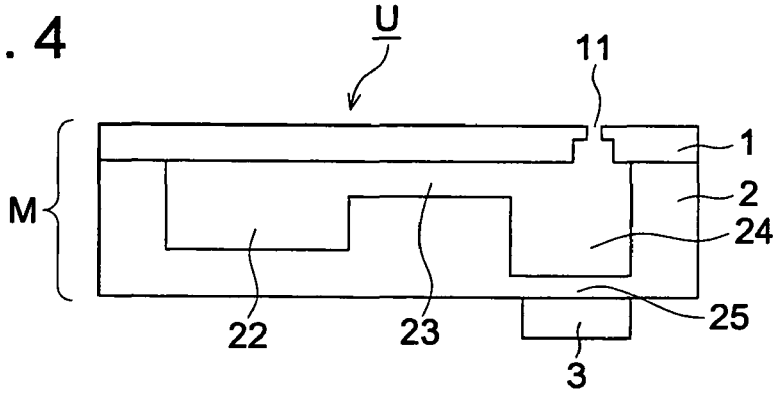
FIG. 4 is a figure showing a cross section of an inkjet type recording head.

FIG. 4 schematically shows a cross section of the recording head U at positions Y-Y' of the nozzle plate 1 and X-X' of the body plate. As shown in FIG. 4, the piezoelectric element 3 is adhered to the flow channel unit M at each surface of the bottom 25 of the pressure chamber 24, which surface is opposed to a surface where the nozzle plate 1 of the body plate 2 is adhered, resulting in a completion of the recording head U. A driving pulse voltage is applied to each piezoelectric element 3 of the recording head U, and vibrations generated from the piezoelectric element 3 are transferred to the bottom 25 of the pressure chamber 24, whereby ink droplets are ejected from the nozzle orifice 11 by causing fluctuation of the pressure in the pressure chamber 24 by the above vibrations of the bottom 25.

Figure 5:
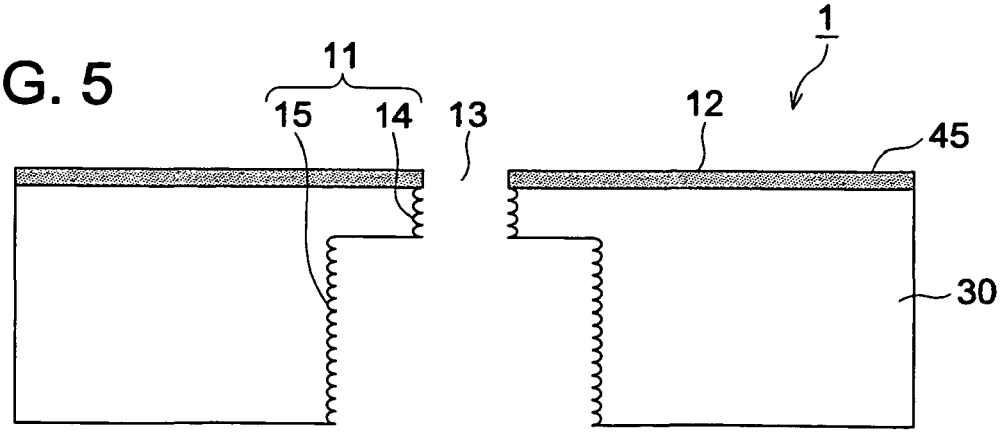
FIG. 5 is a figure showing an example of the surrounding area of an ejection port formed on a nozzle plate.

FIG. 5 shows a surrounding area of one nozzle orifice 11 which is provided by the nozzle plate 1. As shown in FIG. 5, the nozzle orifice 11 is composed of the small diameter section 14 and the large diameter section 15. In addition, as a more preferred embodiment, the ejection surface 12, in which the ejection port 13 for ejecting droplets in the small diameter section 14 exists, is provided with the liquid repellent layer 45. On interior walls of the large diameter section 15 and the small diameter section 14, scallops are schematically drawn, which are formed by the anisotropic etching process in which etching and deposition (formation of a side wall protection film) are alternately repeated.

With regard to manufacturing the nozzle 11 of the nozzle plate 1 which is made by Si, explanation will be made with referring to FIGS. 6 and 7. Each of the large diameter section 15 and the small diameter section 14 is formed on the opposing surfaces of the Si substrate 30.

Figure 6A:
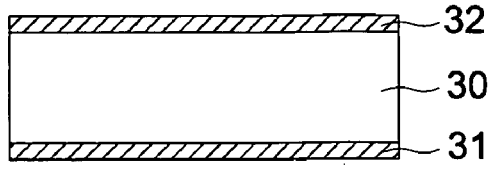
FIG. 6*a* shows a step in forming a large diameter section wherein heat oxidation films (etching mask) are formed on both sides of a substrate.
Figure 6B:
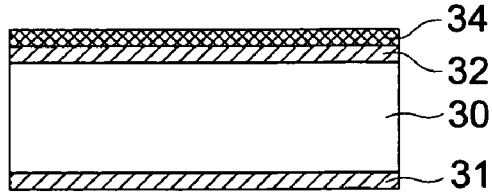
FIG. 6*b* shows a photoresist applied to one surface thereof.

First, formation of the large diameter section 15 will be described with referring to FIG. 6. A method for forming the large diameter section 15 on the Si substrate 30 is not particularly limited to, and the anisotropic etching process in which etching and deposition are alternately repeated can be used in the same way as that of the small diameter section 14 which is described later. The Si substrate 30 is prepared, in which heat oxidation films 32 and 31 composed of $SiO_2$, to be used as an etching mask when etching is performed by the anisotropic etching process, are provided with the both surfaces (FIG. 6*a*).

Figure 6C:
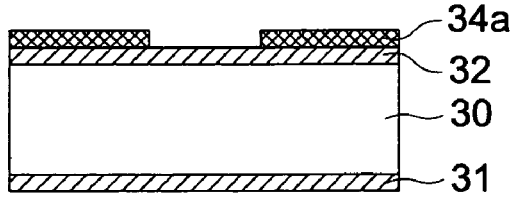
FIG. 6*c* shows a pattern in the photoresist.
Figure 6D:
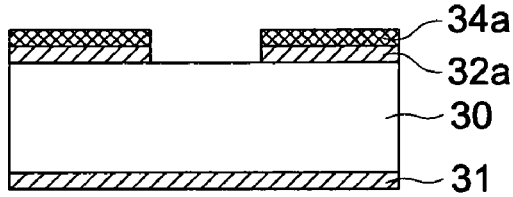
FIG. 6*d* shows the result of anisotropic etching.
Figure 6E:
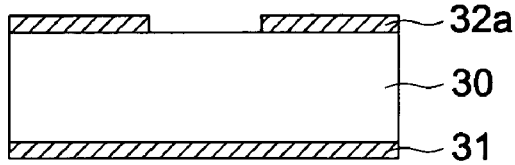
FIG. 6*e* shows the removal of the photoresist etching mask.

Next, the photoresist 34 is applied to the surface of the heat oxidation film 32, which is on the side of forming the large diameter section 15 (FIG. 6*b*), after which the photoresist pattern 34*a* for forming the large diameter section 15 is formed (FIG. 6*c*). Using the photoresist pattern 34*a* as an etching mask, the heat oxidation film pattern is formed via dry etching using, for example, $CHF_3$ (FIG. 6*d*), which pattern is used as an etching mask pattern 32*a* used for the anisotropic etching process.

Figure 6F:
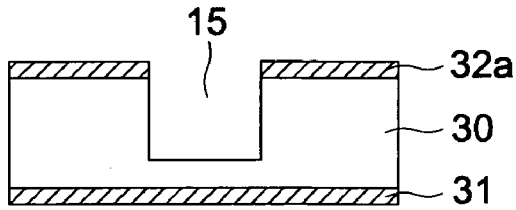
FIG. 6*f* shows an etched substrate with heat oxidation film applied on each side.
Figure 6G:
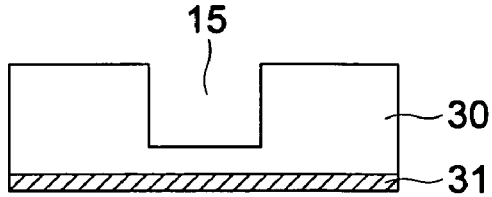
FIG. 6*g* shows removal of the etching masks.

After the photoresist pattern 34*a* being removed (FIG. 6*e*), the large diameter section 15 is formed by the anisotropic etching process in which etching and deposition are alternately repeated (FIG. 6*f*). As an etching apparatus by which the anisotropic etching process is carried out, the ICE type RIE apparatus is preferred. For example, sulfur hexafluoride ($SF_6$) as an etching gas at etching and fluorocarbon ($C_4F_8$) as a deposition gas at deposition are alternately used. After this, the etching mask pattern 32*a* is removed to complete the large diameter section 15 (FIG. 6*g*). As a method for forming the large diameter section 15, the anisotropic etching process in which etching and deposition are alternately repeated was described in the above description, but it is not limited to it. Further, with regard to a depth (a length) of the large diameter section 15, the forming conditions may be decided by carrying out experiments in advance using a method and an apparatus for forming the large diameter section 15 so as to be the prescribed depth.

Next, formation of the small diameter section 14 will be described with referring to FIG. 7. The small diameter section 14 is formed using the anisotropic etching process in which etching and deposition are alternately repeated according to the present invention. The anisotropic etching process is called a Bosch process or the ASE (Advanced Silicon Etching) process.

Figure 7A:
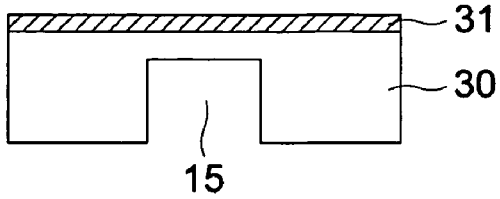
FIG. 7*a* shows the large diameter section of FIG. 6*g* with a heat oxidation film applied to the opposite side.
Figure 7B:
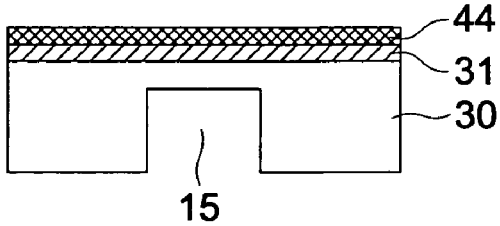
FIG. 7*b* shows a photoresist applied to the heat oxidation film.
Figure 7C:
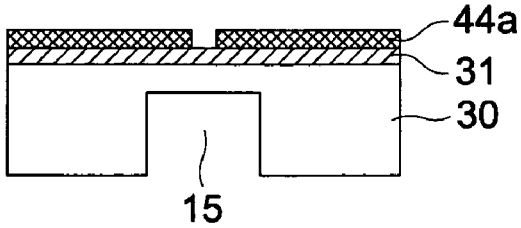
FIG. 7*c* shows a small diameter section in the photoresist.
Figure 7D:
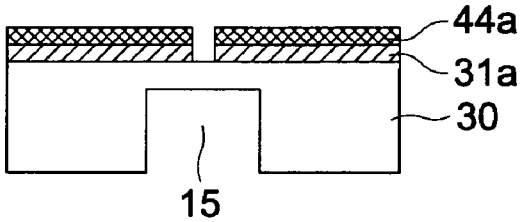
FIG. 7*d* shows etching in the heat oxidation film.
Figure 7E:
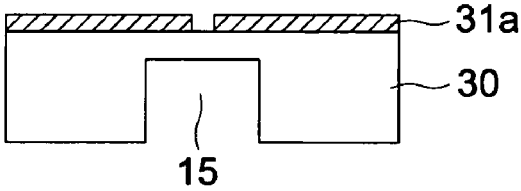
FIG. 7*e* shows removal of the photoresist.
Figure 7F:
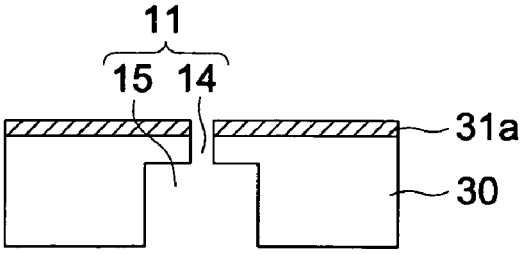
FIG. 7*f* shows etching through the substrate to the large diameter section.
Figure 7G:
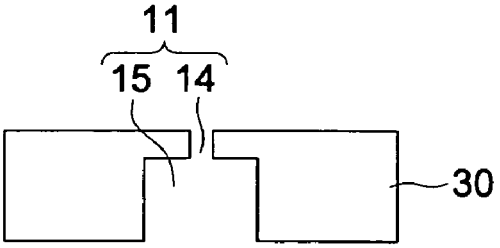
FIG. 7*g* shows the removal of the heat oxidation film.

In the Si substrate 30, on which the large diameter section 15 shown in FIG. 7*a* is formed, the photoresist 44 is applied to the surface of the heat oxidation film 31 of the side where the small diameter section 14 is formed (FIG. 7*b*), after which the photoresist pattern 44*a* for formation of the small diameter section 14 is formed (FIG. 7*c*). Using the photoresist pattern 44*a* as an etching mask, the heat oxidation film pattern is formed (FIG. 7*d*), which pattern is used as an etching mask pattern 31*a* in the anisotropic etching process. After the photoresist pattern 44*a* being removed (FIG. 7*e*), the small diameter section 14 is formed by the anisotropic etching process in which etching and deposition are alternately repeated so that it passes through to the large diameter section 15 (FIG. 7*f*). After this, the etching mask pattern 31*a* is removed (FIG. 7*g*).

In FIG. 7*f*, when the small diameter section 14 is formed by the above anisotropic etching process in which etching and deposition are alternately repeated, the conditional equation 1 below is satisfied.

$$D \leqq 0.1 \times R$$

where,

D: A depth of an etching per one cycle, wherein a formation of etching and side wall protection film in the anisotropic etching process is set to be one cycle.

R: A diameter of an opening of the etching master pattern to form a through hole.

By carrying out the anisotropic etching so as to satisfy the conditional equation 1, the small diameter section 14 having an ejection port with an opening shape equivalent to the etching mask pattern 31*a* can be obtained.

Condition settings to carry out the anisotropic etching, which satisfies the conditional equation 1, can be achieved by regulating conditions such as a slow etching rate, or a fast switching between etching and deposition. The anisotropic etching conditions satisfying the conditional equation 1 are, more specifically, determined in the following steps: First, a diameter R of an opening, which is formed on an etching mask pattern, is determined to form the small diameter section 14. The diameter R corresponds to a desired diameter of an opening of the ejection port 13 of the small diameter section 14. With this, the etching depth D per one cycle satisfying the conditional equation 1 is determined. The etching depth D per one cycle can be achieved by, for example, determining anisotropic etching conditions based on experiments as described below. By changing conditions such as a slow etching rate, or a fast switching between etching and deposition in the etching apparatus to be used, the anisotropic etching is performed, for example, for 50 cycles on the Si substrate on which an etching mask pattern having a desired opening is provided. After this, the part of the orifice on the etched Si substrate is cut off so as to be able to observe the cross section, and the depth of the orifice is determined using an electron microscope, and then the etching depth per one cycle is calculated by dividing the depth with the number of cycles. In this way, the anisotropic etching conditions satisfying the conditional equation 1 can be obtained.

The anisotropic etching process in which etching and deposition are alternately repeated is considered to be an excellent technology for forming a deep groove in a silicon substrate. However, since the etching mechanism is a chemical reaction of radicals or ions with silicon, the etching reaction does not progress only in a longitudinal direction, in a depth direction of a hole, but progresses in a lateral direction, in a side wall direction of a hole, in each etching cycle, to result in a side etching. For this reason, it would be unavoidable that the size of the small diameter section 14 is widened than that of an opening of the etching mask pattern 31*a* in a processing of the small diameter section 14.

As a result of diligent examination of conditions to carry out the anisotropic etching, the inventors focused on a method for reducing an etching amount in the lateral direction by restraining an etching amount in the depth direction (vertical direction) per one cycle of the anisotropic etching. With regard to restraining the etching amount in the lateral direction, it will be described with referring to FIGS. 1 and 2.

Figure 2:
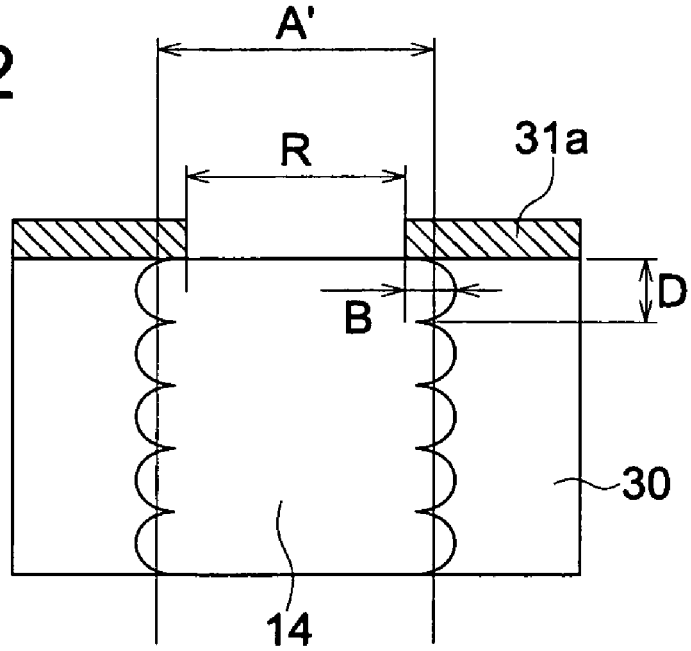
FIG. 2 is a figure showing a relation between a conventional etching amount in the depth direction (a vertical direction) and a conventional etching amount in the lateral direction.

FIGS. 1 and 2 are figures schematically showing a cross section of the small diameter section 14 in which the Si substrate 30, which is provided with the etching mask pattern for forming the small diameter section 14, was etched by the anisotropic etching process of the present invention, shown in FIG. 1 and by a conventional anisotropic etching process, shown in FIG. 2. The diameters R of the opening of the etching mask pattern 31*a* in both FIG. 1 and FIG. 2 are identical.

In the small diameter section 14 shown in FIG. 1, the etching amount D in the depth direction per one cycle is made small compared to that shown in FIG. 2. For this reason, the etching amount in the direction perpendicular to the depth direction of the small diameter section 14 of FIG. 1 can be made smaller than that of FIG. 2. Consequently, the diameter A of the opening of the small diameter section 14 shown in FIG. 1 becomes close to the diameter R of the opening of the etching mask pattern 31*a* compared to the diameter A' shown in FIG. 2. Further, in FIG. 2, it can be fully assumed that, if the opening of the etching mask pattern 31*a* becomes unsustainable due to Si right under the etching mask pattern 31*a* being etched, the change in size or modification of the opening become pronounced. In this way, by performing an anisotropic etching which satisfies the conditional equation 1, the small diameter section 14 having the ejection port 13 of an opening shape equivalent to the etching mask pattern can be obtained.

In case where a diameter of an opening of the ejection port 13 is small, for example, 10 μm or less, the effect that the opening shape becomes equivalent to the etching mask pattern becomes more effective. In case of the conventional anisotropic etching process, since a diameter of the small diameter section 14 is excessively large, or the cause of the deformation is attributable to the etching amount in the lateral direction which was described above, it is assumed that the amount of deformation is limited to about several μm. Therefore, when the desired diameter of the opening becomes large, the possibility that the diameter of the opening becomes larger than the desired one or the opening is deformed becomes small, even if the conventional anisotropic etching process is used. Consequently, the smaller the diameter of the opening of the ejection port 13, more prominent the effect of the present invention becomes.

When the small diameter section 14 is formed by the anisotropic etching of the present invention, if the whole small diameter section 14 is formed by an etching under conditions satisfying the conditional equation 1, the shape of the cross section perpendicular to the depth direction of the small diameter section 14 can be made almost the same as the shape of the ejection port 13 throughout all sections of the small diameter section 14. This is most preferable from a view of flying properties of liquid droplets.

On the other hand, a case may be conceived where manufacturing efficiency of the small diameter section 14 is desired to increase in addition to the flying properties necessary for specifications being secured. In such a case, it is possible to respond to it, for example, after the anisotropic etching satisfying the conditional equation 1 is carried out to a length (a depth) commensurate with the necessary flying properties, by changing the anisotropic conditions to conditions that the etching rate does not satisfy the conditional equations 1 such as higher etching rate.

Next, the liquid repellent layer 45 will be described. The liquid repellent layer 45 is preferably provided at a surface where the ejection port 13 of the nozzle plate 1 as shown in FIG. 5 is present. The arrangement of the liquid repellent layer 45 applies liquid smoothly over the ejection surface 12, whereby liquid may be prevented from oozing out from the ejection port 13 or spreading out. Specifically, for example, materials exhibiting water-repellent property are used when the liquid is aqueous, and materials exhibiting oil-repellent property are used when the liquid is oily. The commonly used materials include fluororesins such as FEP (tetrafluoroethylene, or hexafluoropropylene), PTFE (polytetrafluoroethylene), fluorine siloxane, fluoroalkyl silane, and amorphous perfluororesins, and a film made of the material is formed on the ejection surface 12 via methods such as coating or vapor deposition. The film thickness is preferably about 0.1 to 3 μm, but is not particularly limited to the range.

A thin film of the liquid repellent layer 45 may be directly formed on the ejection surface of the nozzle plate 1, or may be formed through an interlayer in order to improve adhesion of the liquid repellent layer 45.

EXAMPLES

The nozzle plate 1 having a nozzle composed of the small diameter section 14 and the large diameter section 15 as shown in FIG. 5 was manufactured. Hereinafter, the description will be made referring to FIGS. 6 and 7.

As shown FIG. 6*a*, a Si substrate of 200 μm in thickness having the heat oxidation films ($SiO_2$) 31 and 32 of 1 μm in thickness on the both surfaces of the substrate were prepared. The resulting substrate was subjected to the anisotropic etching process in which etching and deposition are alternately repeated as described above, to produce the large diameter section 15 of 100 μm in diameter.

First, the photoresist 34 was coated (FIG. 6*b*), after which the photoresist 34 was subjected to patterning to form a photoresist pattern 34*a* (FIG. 6*c*).

Next, the heat oxidation film 32 was subjected to etching with the photoresist pattern 32*a* being used as an etching mask, to form the etching mask pattern 32*a*. After the photoresist pattern 44*a* was removed (FIG. 6*e*), the Si substrate 30 was subjected to etching using the above etching mask pattern 32*a* with the anisotropic etching process in which etching and deposition are alternately repeated (FIG. 6*f*). As an apparatus by which the anisotropic etching process is carried out, the Multiplex-ICP, manufactured by Surface Technology Systems limited, was used. The conditions of the above anisotropic etching process are described below.

(Etching Conditions)
Gas used: $SF_6$
Gas flow rate: 130 sccm
Process pressure: 2.67 Pa
High frequency electric power: 600 W
Bias electric power: 25 W
One cycle time: 13 seconds
Amount of etching: 1 μm/cycle
(Deposition Conditions)
Gas used: $C_4F_8$
Gas flow rate: 85 sccm
Process pressure: 2.67 Pa
High frequency electric power: 600 W
Bias electric power: 0 W
One cycle time: 5 seconds
Film thickness: 3.3 nm The anisotropic etching was carried out with the above conditions with 185 cycles of etching and deposition being alternately repeated. With the above etching, the depth of the large diameter section 15 was made to be 184.4 μm. Since a Si substrate of 200 μm in thickness was used, the remaining thickness of the Si substrate is 15.6 μm. After this, the heat oxidation film pattern 32*a* was removed by dry etching using $CHF_3$ (FIG. 6*g*).

Next, the small diameter section 14 was produced along the steps of FIG. 7 using the anisotropic etching process in which etching and deposition are alternately repeated on the Si substrate 39 to which the large diameter section 15 produced above was provided. The diameters of the opening of the ejection port 13 of the small diameter section 14 were 1 μm, 5 μm, or 10 μm. A photoresist 44 was arranged on the surface of the heat oxidation film 31 opposing to the surface where the large diameter section 15 was formed (FIG. 7*b*).

Next, a photoresist pattern 44*a* of 5 μm in diameter for forming the small diameter section 14 was formed (FIG. 7*c*) on the Si substrate 30 which was provided with the photoresist 44 using a double-sided mask aligner so that the hole becomes concentric with the previously produced hole of the large diameter section 15 of the Si substrate. The heat oxidation film 31 was etched using the photoresist pattern 44*a*, to form the etching mask pattern 31*a* (FIG. 7*d*). The photoresist pattern 44 was removed (FIG. 7*e*). The diameter R (a circumcircle) of the opening of the etching mask pattern 31*a* to form the ejection port 13 at this step was determined via an electron microscope. The results are shown in subsequent Tables 2 and 3.

Next, the small diameter section 14 was formed using the etching mask pattern 31*a* with the anisotropic etching process in which etching and deposition are alternately repeated (FIG. 7*f*). The anisotropic etching conditions conducted were shown in Table 1 below. After this, the etching mask pattern 31*a* was removed with dry etching using $CHF_3$ (FIG. 7*g*).

Next, the body plate 2 as shown in FIG. 3 was manufactured. Using a Si substrate, and using heretofore known photolithography treatments (a resist coating, an exposure, and a development), and an Si anisotropic dry etching technology, there were formed the pressure chamber grooves 24 which will become a plurality of pressure chambers each of which is communicated with the nozzle 11, the ink supply grooves 23 which will become a plurality of ink supply channels each of which is communicated with the above pressure chamber, and the common ink chamber grooves 22 which will become the common ink chambers each of which is communicated with the above ink supply channel, as well as the ink supply port 21.

Next, as shown in FIG. 3, the nozzle plate 1 prepared so far was pasted with the body plate 2 prepared so far using an adhesive, and then, the piezoelectric element 3, which was a means to generate pressure, was attached to the back surface of each pressure chamber 24 of the body plate 2, to have formed a liquid ejection head. Ejection experiments were carried out using the above liquid ejection head. The results (judgments) of the ejection experiments are given in Tables 2 and 3. In these experiments, the liquid repellent layer 45 shown in FIG. 5 is not arranged.

TABLE 1

| | | Name of Processing Condition | | | | | | | | | |
|---|---|---|---|---|---|---|---|---|---|---|---|
| | | P1 | P2 | P3 | P4 | P5 | P6 | P7 | P8 | P9 | P10 |
| Etching Conditions | $SF_6$ Gas Flow Rate (sccm) | 60 | 60 | 60 | 130 | 130 | 130 | 130 | 130 | 130 | 130 |
| | $C_4F_8$ Gas Flow Rate (sccm) | 40 | 25 | 25 | 50 | 50 | 50 | 0 | 0 | 0 | 0 |
| | Process Pressure (Pa) | 1.3 | 1.3 | 1.3 | 2.6 | 2.6 | 2.6 | 2.6 | 2.6 | 2.6 | 2.6 |
| | High Frequency Electric Power (W) | 500 | 550 | 600 | 500 | 600 | 600 | 500 | 500 | 600 | 650 |
| | Bias Electric Power (W) | 50 | 50 | 50 | 30 | 38 | 50 | 25 | 35 | 25 | 25 |
| | Time (s) | 5 | 5 | 5 | 13 | 13 | 13 | 13 | 13 | 13 | 13 |
| Deposition Conditions | $C_4F_8$ Gas Flow Rate (sccm) | 80 | 80 | 80 | 85 | 85 | 85 | 85 | 85 | 85 | 85 |
| | Process Pressure (Pa) | 1.3 | 1.3 | 1.3 | 2.6 | 2.6 | 2.6 | 2.6 | 2.6 | 2.6 | 2.6 |
| | High Frequency Electric Power (W) | 400 | 400 | 400 | 500 | 600 | 600 | 500 | 600 | 600 | 600 |
| | Bias Electric Power (W) | 0 | 0 | 0 | 0 | 0 | 0 | 0 | 0 | 0 | 0 |
| | Time (s) | 3 | 3 | 3 | 5 | 5 | 5 | 5 | 5 | 5 | 5 |
| | Depth of Etching Per One Cycle (μm/cycle) | 0.06 | 0.1 | 0.12 | 0.35 | 0.45 | 0.55 | 0.7 | 0.75 | 1 | 1.2 |

TABLE 2

| Examples | Diameter R of Opening of Mask pattern (μm) | Depth of Etching D Per One Cycle (μm/cycle) | Processing Condition | D/R | Judgment | Diameter R' of Opening of Ejection Port (μm) | Amount of Broadening H (μm) | H/R (%) |
|---|---|---|---|---|---|---|---|---|
| No. 1 | 5 | 0.45 | P5 | 0.09 | A | 5.5 | 0.5 | 10% |
| No. 2 | 5 | 0.35 | P4 | 0.07 | A | 5.3 | 0.3 | 6% |
| No. 3 | 5 | 0.06 | P1 | 0.012 | A | 5.08 | 0.08 | 1.6% |
| No. 4 | 10 | 0.95 | P9 | 0.095 | A | 11 | 1 | 10% |
| No. 5 | 10 | 0.7 | P7 | 0.07 | A | 10.8 | 0.8 | 8% |
| No. 6 | 10 | 0.06 | P1 | 0.006 | A | 10.07 | 0.07 | 0.7% |
| No. 7 | 1 | 0.1 | P2 | 0.1 | A | 1.05 | 0.05 | 5% |
| No. 8 | 1 | 0.06 | P1 | 0.06 | A | 1.05 | 0.05 | 5% |

TABLE 3

| Comparative Examples | Diameter R of Opening of Mask pattern (μm) | Depth of Etching D Per One Cycle (μm/cycle) | Processing Condition | D/R | Judgment | Diameter R' of Opening of Ejection Port (μm) | Amount of Broadening H (μm) | H/R (%) |
|---|---|---|---|---|---|---|---|---|
| No. 9 | 5 | 1 | P9 | 0.2 | B | 6.5 | 1.5 | 30% |
| No. 10 | 5 | 0.75 | P8 | 0.15 | B | 6.2 | 1.2 | 24% |
| No. 11 | 5 | 0.55 | P6 | 0.11 | B | 5.8 | 0.8 | 16% |
| No. 12 | 1 | 0.12 | P3 | 0.12 | B | 1.15 | 0.15 | 15% |
| No. 13 | 10 | 1.2 | P10 | 0.12 | B | 11.5 | 1.5 | 15% |

The marks "A" and "B" in the judgment column indicate "excellent" and "failure", respectively. The above judgments were made by visual observation of the printed results using the criteria such as a variation of line width which is seemed to be caused by the amount of ejection or a variation of direction of ejection, or a shift of dot position. From the results of the judgment, it is found that when the D/R exceeds 0.1 (that is, D>0.1×R), the judgment becomes failure (B).

The diameter R' (a circumcircle) of the opening of the ejection port of the small diameter section 14 was determined via an electron microscope, and its difference from the diameter R (a circumcircle) of the opening of the etching mask pattern was given in Tables 2 and 3 as an amount of broadening H, just for reference. In addition, the ratio of the H to the diameter R of the opening of the etching mask pattern, H/R (%), was given in the Tables. A relation can be assumed that when the ratio H/R exceeds 10%, the judgments of the above-described printed results become failure.

The invention claimed is:

1. A method for manufacturing a nozzle plate for a liquid ejection head, wherein a through hole whose one opening is an ejection port ejecting liquid is arranged on one side of a Si substrate by an anisotropic etching process in which etching and side wall protection film formation are alternately repeated in the Si substrate, the method comprising the following steps performed in the following order:

forming a hole of an approximately cylindrical shape having a predetermined depth on an other side of the Si substrate from the one side of the substrate;

forming a film to be an etching mask on a surface of the one side of the Si substrate whereupon the ejection port is to be formed;

forming the etching mask pattern having an opening for forming the through hole by performing photolithography and etching to a film to be the etching mask on the one side of the Si substrate; and performing etching by the anisotropic etching process by satisfying a conditional relationship below so that the through hole has an approximately cylindrical shape having a diameter smaller than a diameter of the approximately cylindrical shape of the hole on the other side of the substrate, until the through hole reaches the hole on the other side of the Si substrate:

$$D \leqq 0.1 \times R$$

where D is a depth of an etching per one cycle, wherein, in the anisotropic etching process, a repeating unit in which etching and side wall protection film formation are alternately repeated is set to be one cycle, and R is a diameter of an opening of the etching mask pattern to form the through hole.

2. The method for manufacturing a nozzle plate for a liquid ejection head described in claim 1, comprising providing a liquid repellent layer on the surface of the Si substrate having the ejection port.

3. The method for manufacturing a nozzle plate for a liquid ejection head described in claim 1, wherein the step of forming the hole on the other side of the Si substrate comprises:

forming a film to be an etching mask on a surface of the other side of the Si substrate;

forming the etching mask pattern having an opening for forming the hole by performing photolithography and etching to a film to be the etching mask on the other side of the Si substrate; and performing etching by the anisotropic etching process in which etching and side wall protection film formation is repeated alternately until the hole reaches the predetermined depth.

4. The method for manufacturing a nozzle plate for a liquid ejection head described in claim 3, wherein, in the step of forming the hole on the other side of the Si substrate, a conditional relationship below is satisfied:

$$D2 \leqq 0.1 \times R2$$

where D2 is a depth of an etching per one cycle, wherein, in the anisotropic etching process, a repeating unit in which etching and side wall protection film formation are alternately repeated is set to be one cycle, and R2 is a diameter of an opening of the etching mask pattern to form the hole.

* * * * *